US005463837A

United States Patent [19]

Dry

[11] Patent Number: 5,463,837

[45] Date of Patent: Nov. 7, 1995

[54] METAL ROOF TRUSS

[76] Inventor: Daniel J. Dry, 15823 S. 15th Pl., Phoenix, Ariz. 85045

[21] Appl. No.: 181,615

[22] Filed: Jan. 13, 1994

[51] Int. Cl.[6] ..... F04B 7/02

[52] U.S. Cl. ..... 52/639; 52/634; 52/731.9; 52/92.2; 52/690

[58] Field of Search ..... 52/90.1, 92.1, 52/641, 642, 643, 633–639, 690, 693, 696, 731.7, 731.9

[56] References Cited

U.S. PATENT DOCUMENTS

| | | | |
|---|---|---|---|
| 559,335 | 4/1896 | Kindl . | |
| 1,833,174 | 11/1931 | Norris | 52/731.7 |
| 2,067,403 | 1/1937 | Lea . | |
| 2,234,960 | 3/1941 | Buelow . | |
| 2,284,898 | 6/1942 | Hartman | 52/731.9 |
| 2,541,784 | 2/1951 | Shannon . | |
| 2,642,825 | 6/1953 | McElhone et al. . | |
| 3,129,792 | 4/1964 | Gwynne | 52/634 X |
| 3,243,930 | 4/1966 | Slowinski | 52/731.9 |
| 3,349,535 | 10/1967 | Balinski | 52/634 |
| 3,668,828 | 6/1972 | Nicholas et al. . | |
| 3,845,601 | 11/1974 | Kostecky | 52/690 |
| 3,872,633 | 3/1975 | Altosaar et al. | 52/731.9 |
| 4,235,054 | 11/1980 | Cable et al. . | |
| 4,435,940 | 3/1984 | Davenport et al. . | |
| 4,616,453 | 10/1986 | Sheppard, Jr. et al. | 52/639 |
| 4,878,323 | 11/1989 | Nelson | 52/696 |
| 4,982,545 | 1/1991 | Stromback . | |
| 5,157,883 | 10/1992 | Meyer | 52/696 |

FOREIGN PATENT DOCUMENTS

| | | | |
|---|---|---|---|
| 476296 | 8/1951 | Canada . | |
| 1257031 | 12/1991 | United Kingdom | 52/731.7 |

*Primary Examiner*—Carl D. Friedman
*Assistant Examiner*—Winnie S. Yip
*Attorney, Agent, or Firm*—Donald J. Lenkszus; Snell & Wilmer

[57] ABSTRACT

A metal roof truss for building construction includes top and bottom chord members. Each member is of U-shaped cross-section with each leg of the U having a radiused or rolled hem at the end of the legs of the U. The radiused or rolled hem provides stiffening to the members. In addition, the outward facing surface of the web of the U has dimpled knurling to reduce screw wander.

17 Claims, 2 Drawing Sheets

METAL ROOF TRUSS

BACKGROUND OF THE INVENTION

This invention relates generally to building construction and more particularly to a metal roof truss therefore.

To reduce the costs of building construction, many approaches have been proposed in the past to utilize steel roof trusses. In U.S. Pat. No. 2,541,784 issued to H. S. Shannon, "C" or "U" shaped sections are used for the bottom chord member as well as the top chord members of a building truss. One problem with using just a "C" or "U" shaped section for all the chords is that unless extremely thick steel is utilized, the roof truss may not include enough rigidity to adequately support roof loading unless additional trusses are added.

Another roof truss arrangement is shown in U.S. Pat. No. 4,435,940 issued to Jeanne A. Davenport, et al. and a similar arrangement is described in U.S. Pat. No. 4,982,545 to Gustaf M. Stromback. In both of these prior truss arrangements, the horizontal, bottom chord section of a roof truss is formed from a U-shaped section of sheet steel. In the Stromback patent the ends of the legs of the U are tightly folded back to form a double thick edge. The top chords of both the Davenport and the Stromback patent are formed of inverted U-shaped sections having flanges projecting outwardly from the ends of each of the legs to provide greater rigidity.

One difficulty with both of those prior approaches to manufacturing of metal roof trusses is that different components are used for the bottom chords and the top chords resulting in two different fabrication lines or at least two different set ups for fabrication lines being required. Furthermore, two different stock items must be maintained in inventory. In addition, because of the flanges on the top chord members it is necessary to provide for cutting the flanges off at least one of the top chords at the apex of the truss.

One further problem which has occurred in the utilization of metal roof trusses is the difficulty of fastening roofing material to the flat surface of the truss members. When it is attempted to utilize power screws, it is quite common for the screw to wander on the flat steel surface.

SUMMARY OF THE INVENTION

In accordance with the principles of the invention, a new and improved metal roof truss has been developed.

In a roof truss in accordance with the principles of the invention, the bottom horizontal chord piece as well as the top chord pieces are of substantially uniform shape and cross-section. Both the bottom and top chord members include a radiused or rolled hem at the end of the legs.

Further, in accordance with the principles of the invention, one or more stiffening ribs are formed in the side walls of the chord members.

Still further in accordance with the principles of the invention, at least the bottom chord member has its exterior surface of the web shaped portion knurled to reduce wandering of screws.

DETAILED DESCRIPTION

The invention may be better understood from a reading of the following detailed description taken in conjunction with the drawings in which.

DETAILED DESCRIPTION

Figure 1:
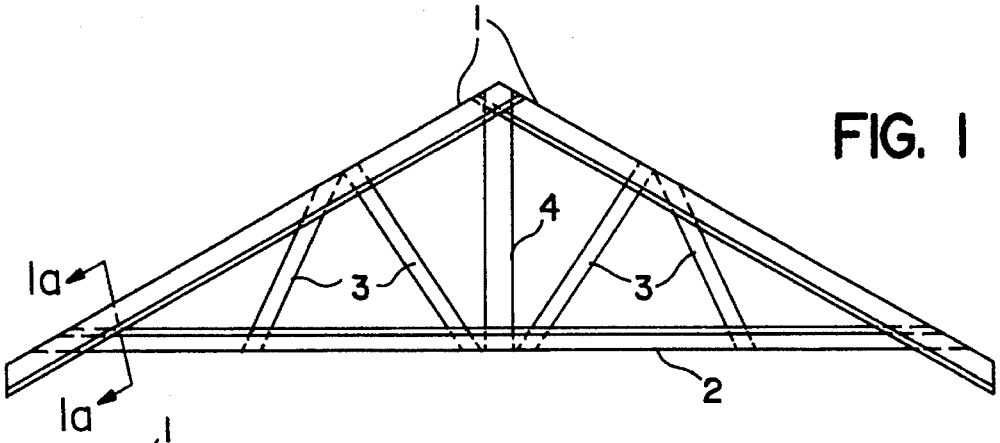
FIG. 1 illustrates a roof truss assembled from materials accordance with the principles of the invention.

As shown in FIG. 1, a roof truss includes a pair of top chords 1 and a bottom chord 2. The two top chords 1 are joined together at the apex and are each fastened to the bottom chord member 2. Each of the chords 1 and 2 are generally of "U"-shaped cross-sections. The two top chords are interfitted together at the apex and fastened together with any one of a number of known fastening techniques. Most commonly, the two top chord members will be fastened together by means of screws. Likewise, the bottom chord interfits within each of the two top chords 1 and is fastened at its ends to each of the chords 1 by means of screws.

Disposed between the top chords 1 and the bottom chord 2 are diagonal members 3 and a member 4. Each of the members 3 and 4 are interfitted into the respective top and bottom chords. Likewise, the end of member 4 is interfitted into the bottom chord 2 and securely fastened thereto by means of screws. The other end of member 4 is interfitted between the two top chords 1 and again fastened by screws. Each of the diagonal members 3 and the member 4 may be of any "C" or "U"-shaped section generally known in the art or they may, in fact, be of the same stock material as the top chords 1 or the bottom chord 2.

Figure 1A:
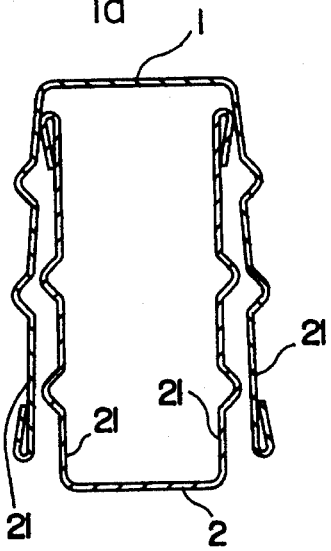
FIG. 1A illustrates in cross-section the interfitting of two members of the roof truss of FIG. 1, the cross-section being taken at lines 1A—1A of FIG. 1.
Figure 1B:
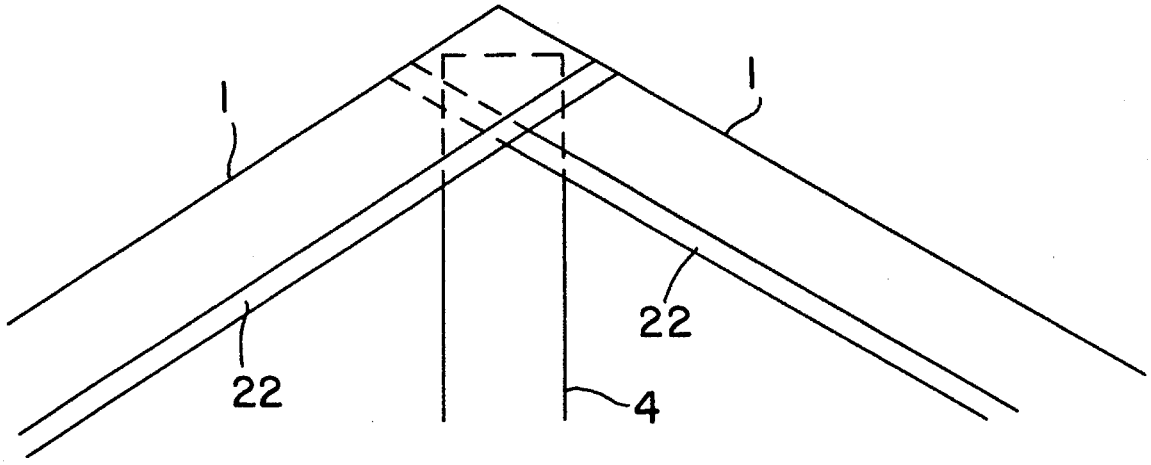
FIG. 1B illustrates in greater detail the top portion of the roof truss of FIG. 1.

FIG. 1A illustrates in more detail how the various members are connected by interfitting. More specifically, FIG. 1A illustrates how the bottom chord member 2 interfits at its left end into the left top chord 1. Because the chords are of relatively thin-gauged steel stock, the legs 21 of the top chord will flex outward and the legs 21 of bottom chord 2 will flex inward such that the end of chord 2 may be slid into chord 1. Similarly, the top chord members 1 interfit as shown in FIG. 1 and in more detail in FIG. 1B except as shown in FIG. 1 each of the two chords 1has the open side of the "U" shaped chord facing in substantially the same downward direction. As is apparent from FIG. 1B, the radiused hem 22 of the top chord 1 which extends downward to the right in the drawing contacts the inner surface of the other top chord 1 which extends downward to the left.

Figure 2:
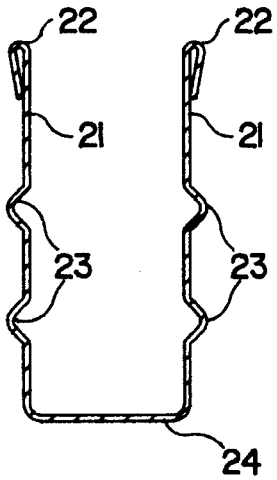
FIG. 2 illustrates in cross-section the top and bottom chord member of the roof truss of FIG. 1.

Turning now to FIG. 2, a cross-section of the top chords 1 and the bottom chord 2 is shown. As can be seen, the chords are a generally U-shaped cross-section, made of relatively thin-gauged steel stock which typically may be of 14, 16, 18 or 20 gauge, the gauge being determined by the span to be traversed between the side walls.

Figure 3:
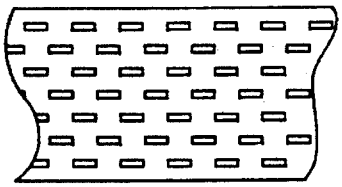
FIG. 3 illustrates a representative knurled pattern utilized on an exterior surface of the top and bottom chord member of FIG. 1.

An important aspect of the present invention is that the end portions of each of the legs 21 includes a rolled or radiused hem portion 22. This is to be distinguished from a smashed or tight hemmed end in prior arrangements such as shown in FIG. 3 of U.S. Pat. No. 4,982,545. It has been found that by providing a radiused or rolled hem, significant stiffening occurs in the chord members.

Additional stiffening can be provided by means of longitudinal ribs 23 on the side walls 21. By utilizing U-shaped stock section such as shown in FIG. 2, trusses are easily constructed. In fact, in contrast to the prior arrangements wherein different stock material was used for the top chords and the bottom chords, one significant advantage of truss construction in accordance with the present invention is that stock of a single type may be used. The construction therefore becomes much more similar to that of assembling trusses of wood material.

Turning back to FIG. 1, the diagonal supports 3 and the member 4 can be made of either generally available metal stud material or can also be formed of the same stock material utilized for the top and bottom chords.

Further adding to the similarity of manufacturing the trusses in a manner similar to that of wood trusses, each of the chord members can be made from stock in standard sizes similar to that of the standard sizes of construction grade wood. For example, in the embodiment of FIG. 1, the chord members 1 and 2 may be sized the same as construction lumber. In such a case where 2×4 equivalents are used, the outside dimensions of the bottom of the cross-section shown in FIG. 2 would be slightly greater than 1½" and the height from the bottom 24 to the top of the rolled hem 22 would be 3½". The radius of the ribs 23 would be ⅛. The rolled hem 22 would extend down from the top by approximately ½" and would be radiused such that at the top of the radiused hem, the exterior dimension would be approximately 11/64". In such a case, the member would be formed of 20-gauge steel stock.

As noted above, one problem with prior art truss arrangements when affixing either roof sheeting to the top chords or ceiling stock to the bottom chord, the screws have a tendency to wander about the smooth surface. Accordingly, surface 24 of each of the chord members is knurled to limit the wandering of screws. As more clearly seen in FIG. 3, a dimple knurl is used in the illustrative embodiment. With this arrangement it has been found that the problem of wander is substantially eliminated.

Figure 4:
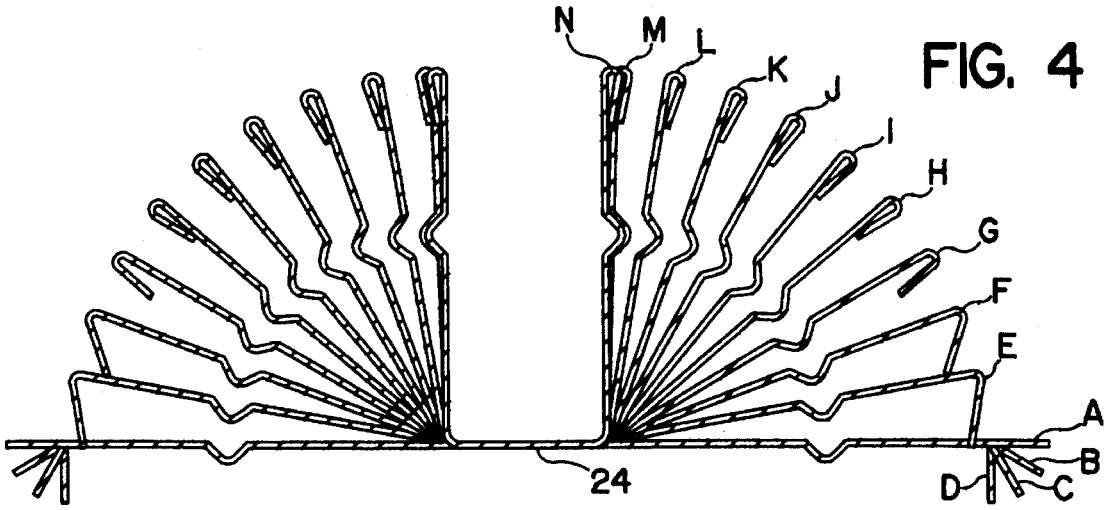
FIG. 4 illustrates the fabrication steps necessary to go from flat roll stock to truss chord members in accordance with the principles of the invention.

Turning now to FIG. 4, the various steps in the manufacture of the chord stock is illustrated. To fabricate flat steel stock into a cross-section such as that of FIG. 2, approximately 13 rolling stands are used. As shown in FIG. 4 which illustrates yet another configuration of stiffening ribs, shape A is the flat steel stock before being run through the 13 rolling stands. Superimposed upon the flat stock A is the output of each of the rolling stands B through N. It should be noted that the dimple knurling shown in FIG. 3 can be provided on bottom surface portion 24 at any of the rolling stands.

It will be understood by those skilled in the art that changes and modifications may be made to the invention without departing from the spirit or scope thereof. Therefore it is intended that the foregoing description is merely for illustrative purposes and not intended to limit the spirit or scope of the invention in any way.

What is claimed is:

1. A metal building truss comprising:

a bottom chord member of lightweight material;

first and second top chord members each being of lightweight material;

said top chord members being coupled together at an upper end, and each end of said bottom chord member being coupled to a lower end of one of said first and second top chord members, each of said top chord members and said bottom chord members being of generally U-shaped cross-section formed by a web and two legs extending from said web, the top end of each leg terminating in a radiused hem to provide stiffening;

each radiused hem being formed by the corresponding leg having a first portion extending from said web and a second portion turned back toward said web, said second portion being spaced apart from said first portion at the ends of said first and second portions furthest from said web whereby the thickness of said hem furthest from said web is greater than twice the thickness of said material, said second portion at its end closest to said web being substantially in contact with said first portion and;

one of said ends of said bottom chord member with said radiused hem interfits between the legs of said lower end of said first top chord member and the other one of said ends of said bottom chord member with said radiused hem inferfits between the legs of the lower end of said second top chord member.

2. A truss in accordance with claim 1 further comprising:

a plurality of diagonal members disposed between said bottom chord and said first and second top chords.

3. The truss in accordance with claim 1 wherein:

each leg of each chord member includes at least one stiffening rib formed thereon.

4. A truss in accordance with claim 3 wherein:

at least one of said bottom, first top and second top chord members has an exterior surface of its web formed to reduce the wander of screws.

5. A truss in accordance with claim 4 wherein:

said exterior surface has a knurled pattern formed thereon.

6. A roof truss in accordance with claim 5 wherein:

said knurled pattern comprises dimple knurling.

7. A metal building truss in accordance with claim 1 comprising:

at least a first diagonal member connected between said first top chord member and said bottom chord member; and a second diagonal member coupled between said second top chord member and said bottom chord member.

8. A metal building truss comprising:

first top, second top, and bottom chord members each being formed of metal and having a generally U-shaped cross-section formed by a web and two leg extending from said web to form a channel, a top end of each said leg having formed thereon a radiused hem to provide stiffening;

each radiused hem being formed by the corresponding leg having a first portion extending from said web, and a second portion turning back toward said web, said second portion being spaced apart from said first portion at their respective ends furthest from said web whereby the thickness of said hem at the end furthest from said web is greater than twice the thickness of said material, and said second portion at its end closest to said web being in substantial contact with said first portion;

said first top chord member having an unmodified end with said radiused hem interfitting into the channel of an unmodified end portion of said second top chord member, such that said radiused hem of said first top chord member engages an inner surface of said second top chord member, said first and second top chord members being securely fastened together;

said bottom chord member having one end connected to a lower end portion of said top chord member and its other end connected to a lower end portion of said second top chord member.

9. A building truss in accordance with claim 8 wherein:

said one end of said bottom chord member interfits between the legs of said first top chord member and said other end of said bottom chord member interfits between the legs of the second top chord member.

10. A building truss in accordance with claim 8 wherein:

an exterior surface of the web of at least one of said first top, second top or bottom chord members is formed so as to reduce the wander of screws being driven into said web.

11. A building truss in accordance with claim 10 wherein:

said surface has formed thereon a pattern of depressions.

12. A roof truss in accordance with claim 11 wherein:

said pattern comprises dimple knurling.

13. A metal building truss in accordance with claim 10 wherein:

said web of each of said first top, second top and bottom chord members having said exterior surface formed so as to reduce the wander of screws being driven therein.

14. A building truss in accordance with claim 13 wherein:

each said exterior surface of each said web of said first top, second top and bottom chord members has a pattern of depressisons formed thereon.

15. A building truss in accordance with claim 8 further comprising:

at least one member extending between said bottom chord and at least one of said first and second top chords.

16. A building truss in accordance with claim 15 wherein:

each said member is of U-shaped cross-section formed by a web and two legs extending from said web to form a channel, the top end of each said leg having formed thereon a radiused hem to provide stiffening.

17. A building truss in accordance with claim 8 wherein:

each of said first top, second top and bottom chord members further includes at least one rib integrally formed in each leg to further provide stiffening.

* * * * *

UNITED STATES PATENT AND TRADEMARK OFFICE

CERTIFICATE OF CORRECTION

PATENT NO. : 5,463,837

DATED : November 7, 1995

INVENTOR(S) : Daniel J. Dry

It is certified that error appears in the above-indentified patent and that said Letters Patent is hereby corrected as shown below:

In Col. 1, line 53, after "the", delete "end" and insert "edge".

In Col. 2, line 1, insert --in-- at the beginning.

In Col. 2, line 8, insert --s-- at the end of "member".

In Col. 3, line 27, insert --"-- at the end of "1/8".

In Col. 4, line 48, insert --s-- at the end of "leg".

In Col. 6, line 6, delete "depressisons" and insert --depressions--.

Signed and Sealed this

Twenty-third Day of April, 1996

Bruce Lehman

*Attest:*

BRUCE LEHMAN

*Attesting Officer*

*Commissioner of Patents and Trademarks*